United States Patent [19]

Jacobsson

[11] Patent Number: 4,628,710

[45] Date of Patent: Dec. 16, 1986

[54] YARN-FEEDING APPARATUS AND METHOD FOR CONTROLLING IT

[75] Inventor: Kurt A. G. Jacobsson, Ulricehamn, Sweden

[73] Assignee: Aktiebolaget IRO, Ulricehamn, Sweden

[21] Appl. No.: 680,337

[22] PCT Filed: Apr. 9, 1984

[86] PCT No.: PCT/EP84/00106

§ 371 Date: Dec. 4, 1984

§ 102(e) Date: Dec. 4, 1984

[87] PCT Pub. No.: WO84/03906

PCT Pub. Date: Oct. 11, 1984

[30] Foreign Application Priority Data

| | | | |
|---|---|---|---|
| Apr. 7, 1983 | [SE] | Sweden | 8301934 |
| May 20, 1983 | [SE] | Sweden | 8302891 |
| May 20, 1983 | [SE] | Sweden | 8302892 |
| Jul. 7, 1983 | [SE] | Sweden | 8303895 |
| Oct. 10, 1983 | [SE] | Sweden | 8305547 |

[51] Int. Cl.[4] ..... D04B 35/12; D04B 35/16

[52] U.S. Cl. ..... 66/132 T; 66/138; 66/163

[58] Field of Search ..... 66/132 T, 138, 157, 66/161, 163, 232

[56] References Cited

U.S. PATENT DOCUMENTS

| | | | |
|---|---|---|---|
| 4,031,718 | 6/1977 | Luth | 66/232 |
| 4,386,508 | 6/1983 | Jacobsson | 66/132 T |

FOREIGN PATENT DOCUMENTS

| | | | |
|---|---|---|---|
| 8101301 | 5/1981 | European Pat. Off. | 66/132 T |
| 2421131 | 10/1979 | France . | |
| 1191027 | 5/1970 | United Kingdom | 66/138 |
| 742502 | 6/1980 | U.S.S.R. | 66/157 |

*Primary Examiner*—W. Carter Reynolds

*Attorney, Agent, or Firm*—Flynn, Thiel, Boutell & Tanis

[57] ABSTRACT

A yarn-feeding apparatus for selective positive feeding of several yarns to a knitting machine, comprising a sensor for generating sensor signals, the sensor signals representing the respective feeding condition or non-feeding condition of the yarns, and an error detection unit connected to the sensor for turning off the knitting machine in response to predetermined sensor signal combinations representing a yarn breakage and/or a yarn over-feed and/or a yarn change fault. For shortening the response time of the error detection unit and for enhancing the reliability thereof, the error detection unit comprises a working position sensing unit for generating position data representing the working position of the knitting machine, a logic circuit for deriving a yarn changing signal from the sensor signals, and a memory unit for storing yarn changing position data. The error detection unit determines whether the actual position data falls within a data range defined by the stored position data, and disenables the turning off of the knitting machine if the actual position data falls within the data range.

16 Claims, 9 Drawing Figures

INTERRUPT - SUBROUTINE

YARN-FEEDING APPARATUS AND METHOD FOR CONTROLLING IT

FIELD OF THE INVENTION

The present invention relates to a yarn-feeding apparatus for the selective positive feeding of several yarns to a knitting machine and to a method for controlling the operation of a yarn-feeding apparatus.

BACKGROUND OF THE INVENTION

A yarn-feeding apparatus of the type to which the invention relates is disclosed in the applicant's own non-prepublished European patent application No. 83 105 136.2 and in the applicant's own international patent application having the application number PCT/EP8300 131. These prior applications describe a yarn-feeding apparatus having a plurality of yarn-feeding wheels which are freely rotatable. These wheels are driven by respective belts engaging a portion of the circumference thereof. These belts are driven in synchronism with the knitting machine in order to supply a plurality of yarns from spools to the knitting machine. Yarn-feeding elements having eyelets for guiding the respective yarns are rotatably supported about an axis perpendicular to the axis of the wheels. The yarn-feeding elements comprise input-guiding elements and output-guiding elements fixedly connected to each other and pivotally supported with respect to said axis. If the knitting machine puts tension on a yarn which is to be fed to the knitting machine, the corresponding yarn-feeding element pivots against the force of a spring, whereby the input-guiding element of this yarn-feeding element urges the corresponding yarn between the belt and the freely rotatable wheel. Hence, the yarn is positively fed to the knitting machine if the knitting machine puts tension to this yarn. During usual operation of the knitting machine, only one yarn is positively fed by the apparatus. In case a change of colour is required, the knitting machine terminates the knitting operation carried out with one yarn, reduces the tension occurring in this yarn and thereby enables the spring to pivot the yarn-feeding element such that the yarn comes in the non-feeding area of the feeding wheel. Thereinafter, the tension in the yarn to be knitted next rises, so that the corresponding yarn-feeding element pivots in its feeding position, in which the yarn comes in the region of engagement of the belt and the feeding wheel. Each yarn-feeding element comprises a sensor generating a sensor signal representing the feeding-position or non-feeding position of the respective yarn-guiding element and thereby representing the respective feeding condition or non-feeding condition of each yarn.

During normal operation, i.e. if no yarn breakage or yarn over-feed or yarn change fault occurs, only one yarn is fed to the knitting machine, so that only one sensor generates a signal. During the changing of the yarn fed to the knitting machine, a simultaneous generation of two sensor signals in case of a knitting machine having an overlapping feeding of the old yarn and the new yarn or the generation of no signal in case of a knitting machine having a non-overlapping feeding of the old yarn and the new yarn takes place during a relatively short period of time. In case of a yarn breakage or a yarn over-feed, no signal is generated by the sensors. In case of a "two yarn"-condition caused by a yarn change, i.e. a fault of simultaneous feeding of at least two yarns to the knitting machine, two sensor signals are generated. Hence it is possible to detect a yarn breakage and a yarn over-feed or a two yarn condition by checking whether a sensor signal combination representing the feeding of no yarn or the feeding of at least two yarns occurs during a period of time exceeding the period of time of the yarn changing operation. For this purpose the apparatus comprises an error detection unit connected to the sensor means for turning off the knitting machine in response to predetermined sensor signal combinations representing a yarn breakage and/or a yarn over-feed and/or a yarn change fault which occur during a period of time exceeding a predetermined time limit. In other words, only sensor signal combinations occurring during a period of time exceeding the time period of a time element of the error detection unit cause the turning off of the knitting machine. Therefore, the error detection unit turns off the knitting machine with a relatively great time-delay which is undesirable, because the knitting machine should be immediately turned off when a yarn breakage or a yarn over-feed occurs so as to prevent damage caused by such an erroneous yarn condition. The detection of an over-feeding of yarn is disregarded during the time period of the time element of the error detection unit, which can result in a so-called "press-off" in the knitting machine, i.e. that the fabric is lost by the knitting needles, which fault takes a considerable amount of time to repair, especially in case of a so-called rib circular knitting machine. Another problem caused by this prior art yarn-feeding apparatus consists in that the time period of the time element defining the time during which the occurrence of a sensor signal combination representing a yarn error is disregarded only exceeds the time for carrying out the yarn-changing operation in case of the normal speed mode of the knitting machine. In case of the so-called "crawl speed mode" of the knitting machine the colour change is carried out more slowly than during the normal speed mode of the knitting machine, so that the error detection unit tends to turn off the knitting machine in case of a yarn changing operation of the knitting machine carried out during its "crawl speed mode". This drawback of the prior yarn-feeding apparatus could only be overcome by extending the time period of the time element for reducing the possibility of erroneous shut-off operations. However, this measure increases the likelihood of disregarding a yarn breakage and/or a yarn over-feed, so that the risk of turning off the knitting machine too late increases.

The present invention is based on the technical task as how to further develop a yarn-feeding apparatus and a method of controlling it such that the reliability of the operation of the yarn-feeding apparatus increases.

SUMMARY OF THE INVENTION

This technical task is solved by a yarn-feeding apparatus in accordance with the invention.

The present invention is based on the technical idea to determine the working position of the knitting machine when a change of yarns takes place, to store the determined working position data, and to disenable the turning off of the knitting machine in response to the predetermined sensor signal combination if the sensor signal combination is generated when the machine has a working position which comes close to the determined working position at the moment of the generation of the yarn changing signal.

In accordance with the invention, the error detection unit comprises a working position sensing unit for generating position data representing the working position of the knitting machine. The error detection unit reads the working position data generated by the working position sensing unit and stores the position data in the memory means when the yarn changing signal indicates the changing of yarns. Then the error detection unit continuously reads the actual position data generated by the working position sensing unit and determines whether the actual position data falls within a data range which is defined by the stored position data. If this condition is fulfilled the error detection unit disregards the occurrence of predetermined sensor signal combinations, as these combinations are caused by the yarn changing operation which takes place when the actual position data falls within a data range being defined by the stored position data.

In case of a circular knitting machine having a needle cylinder and at least one knitting system, the working position sensing unit measures the relative angular position of the needle cylinder with respect to a knitting system. Hence, the generated position data represents the working angle of the knitting machine.

In case the knitting machine is a circular knitting machine, the working position sensing unit can be simply implemented by standard electronic elements available on the market, namely by a first pulse generator generating one pulse per revolution of the knitting machine and by a second pulse generator generating a pulse train having a frequency which is proportional to the rotary velocity of the knitting machine. The second pulse generator can be for example associated with a gear fixed to the rotating knitting cylinder whereby the second pulse generator generates one pulse per tooth of the gear. The pulses generated by the second generator are counted by a first counter which is periodically reset by the pulse generated by the first pulse generator. Hence, the count of the first counter represents the angular working position of the knitting machine, i.e. the angular position of the needle cylinder with respect to the knitting system.

For determining the lower boundary of the data range, the error detection unit reads the count of the first counter at the moment of generation of the first yarn changing signal. Thereinafter the error detection unit subtracts a predetermined number from this count whereby the lower boundary of the data range is determined. In other words, the lower boundary of the data range is slightly offset with respect to the working position corresponding to the count of the counter in a direction opposite to the working direction of the knitting machine. Thus even a slight varying of the angular position of the knitting machine at the moment of generation of yarn changing signals during subsequent machine cycles will not influence the reliable disenabling of the turning off of the knitting machine during the yarn changing operation.

The early determination of the yarn changing position data is possible, as the angular position of the knitting machine at the beginning of each yarn changing operation remains unchanged. Hence, the yarn changing position data do not have to be refreshed during subsequent machine cycles of the knitting machine.

The preferred embodiment is a possible implementation of the basic idea of creating a data range defined by the stored position data for disenabling the turning off of the knitting machine if the actual position data falls within this data range. The second counter is started by the comparing means as soon as the actual position corresponding to the count of the first counter exceeds the yarn changing position data, corresponding to the lower boundary of the data range. Thereinafter the second counter counts the pulses received from the second generator and disenables the turning off of the knitting machine as long as its count does not exceed a predetermined boundary. Hence, the occurrence of predetermined sensor signal combinations does not result in the turning off of the knitting machine if the angular position of the knitting machine is within a positional range in which the knitting machine carries out the yarn changing operation.

The disenabling of the turning off of the knitting machine during the counting operation of the second counter can be easily implemented in the error detection unit. The third and fourth counters serve to determine the period of time during which a sensor signal combination representing a yarn error occurs, so that a short appearance of such a predetermined sensor signal combination does not result in an interruption of the operation of the knitting machine. By resetting these counters during the counting operation of the second counter, sensor signal combinations representing a yarn error are disregarded if the angular position of the knitting machine corresponds to its angular position during a yarn changing operation.

The implementation of the logic circuit, the first to fourth counters and the comparing means by respective software routines stored in a memory of a microprocessor results in a very simple circuit design.

The inventive method provides a reliable detection of the occurrence of a yarn breakage and a yarn over-feed for turning off the knitting machine without any greater time delay.

By choosing the lower threshold such that it corresponds to an angular position of the knitting machine which is angularly offset with respect to the yarn changing position in a direction opposite to the working direction of the knitting machine, a corresponding variation of the angular position of the knitting machine at the beginning of the yarn changing operation can take place. A reliable error detection without any risk of erroneously turning off of the knitting machine is achieved by determining the upper threshold in accordance with the invention.

It is advantageous in the case of a circular knitting machine if the determination of an angular range of working positions for disregarding the occurrence of sensor signal combinations representing yarn errors on the basis of pulses is easily carried out with a microprocessor which is programmed with corresponding software counting routines.

BRIEF DESCRIPTION OF THE DRAWINGS

Hereinafter, preferred embodiments of the present invention are described with reference to the attached drawings.

DETAILED DESCRIPTION

Figure 1:
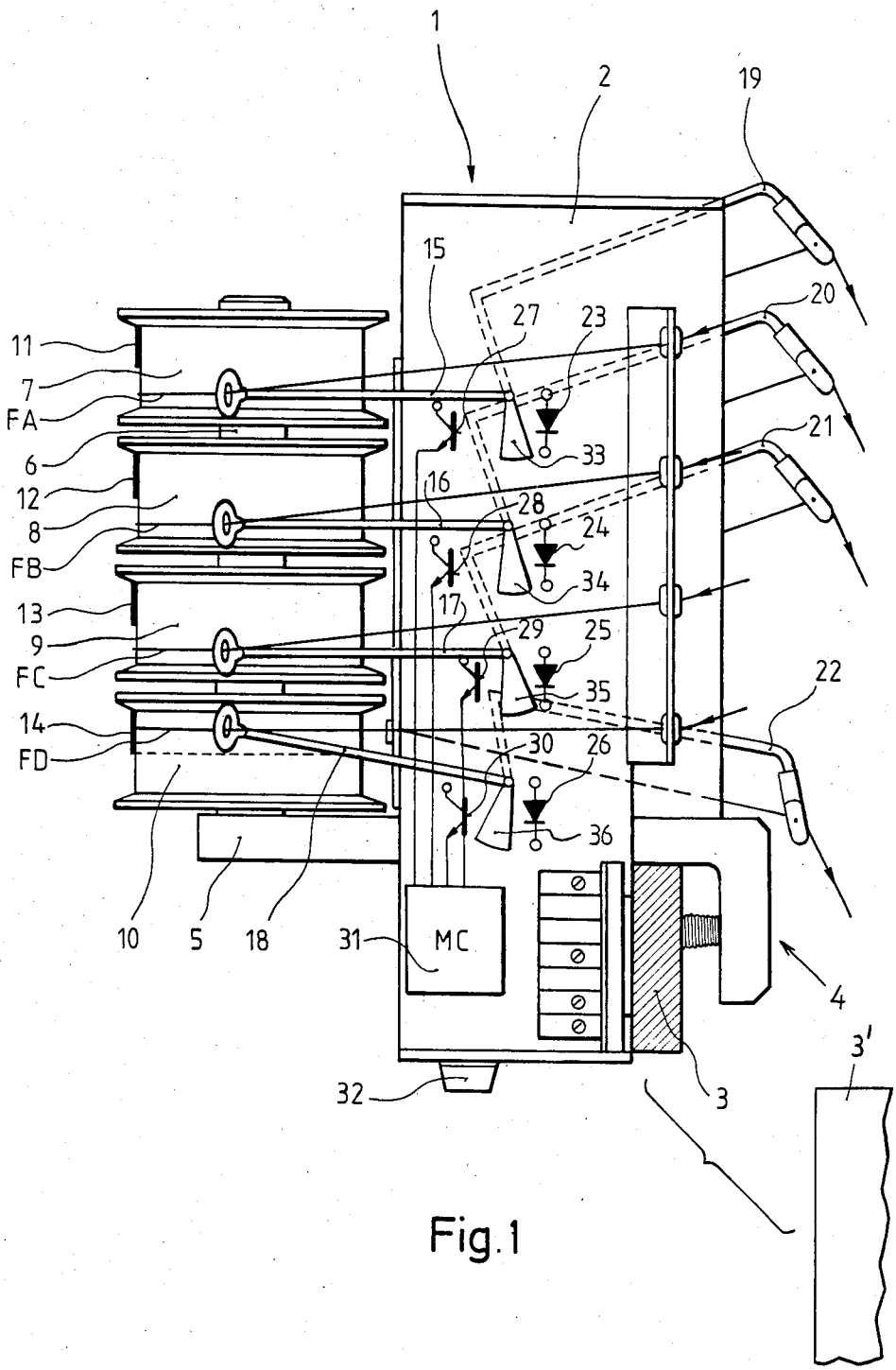
FIG. 1 shows a side-view of a yarn-feeding apparatus.

According to FIG. 1, a yarn-feeding apparatus 1 comprises a housing 2 on which is mounted a clamp portion 4, with which the yarn-feeding apparatus can be secured on a circular support ring 3 above an associated knitting system in a horizontal circular knitting machine. In a multi-system circular knitting machine, the needle cylinder of which is diagrammatically represented at 3' there are provided as many yarn-feeding apparati as there are knitting systems in the knitting machine. The clamp portion 4 has a support plate 5 for a vertical axle 6, on which four yarn-feeding wheels 7,8,9, and 10 are freely rotatably supported, namely one above the other. A portion of the circumference of each yarn-feeding wheel has a belt 11, 12, 13 and 14 engaging it. The belts are driven in a conventional manner in synchronism with the knitting machine in order to supply in this case four yarns FA, FB, FC, FD, which come from yarn spools not shown here. The yarns are then fed, preferably through guiding eyelets, to the fingers in a striper box mechanism (not illustrated), from where they then run to the knitting needles in the knitting machine.

A yarn-feeding apparatus of the above-mentioned type is known per se in the art, for example, from EP-A-80 10 671.9 (corresponds to U.S. Pat. No. 4,386,508).

Yarn-guiding arms 15–18 and 19–22 are pivotally supported with respect to the housing 2. Each yarn-guiding arm comprises an input-guiding element 15–18 and an associated output-guiding element 19–22 which is fixedly connected therewith. There is provided one yarn-guiding arm for each yarn FA, FB, FC and FD.

Each input-guiding element 15–18 can be pivoted back and forth against the force of a spring (not illustrated) which urges it counter-clockwise.

When the yarn-guiding arm of a yarn is in a feeding-area position, the yarn lies under the belt 11–14 and is positively fed by the same. When the yarn-guiding arm for a yarn is in the non-feeding-area position, the yarn lies outside of the region of engagement of the belt and is no longer fed.

In FIG. 1 the input-guiding element 18 and the output-guiding element 22 are in the feeding-area position, so that the yarn FD is fed positively, while the other yarn-feeding elements are in their non-feeding-area positions, so that the other yarns FA, FB and FC are not fed. In other words, the yarn-guiding arm associated with the yarn which is fed is rotated by a predetermined angle in the clockwise direction when compared with the angular position of the other yarn-guiding arms. Hence, the respective feeding state or non-feeding state of each yarn can be detected by measuring the angular position of each yarn-guiding arm. For this purpose, four segments 33–36 are fixed to the yarn-guiding arms 15–18, wherein these segments serve to interrupt a respective light beam generated by light emitting diodes 23–26 located at one side of these segments opposite to four photo-transistors 27–30. With this arrangement an opto-electronic detection of the position of the yarn-guiding arms can be made. The respective segments 33–36 are located such with respect to the light emitting diodes 23–26 and to the photo-transistors 27–30 that the light beam from the light emitting diode to the transistor is interrupted when the corresponding yarn-guiding arm is in its non-feeding-area position.

The respective collectors of the transistors 27–30 are connected to positive voltage supply, wherein the respective emitters are connected to input terminals of a microcomputer 31.

Figure 2:
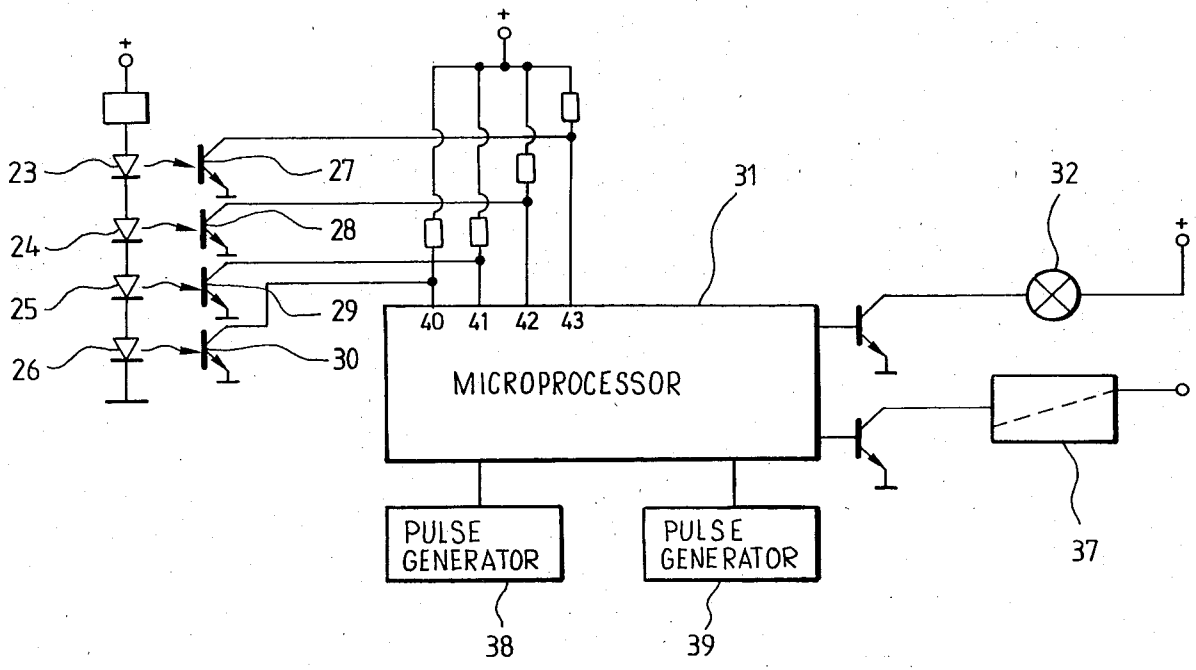
FIG. 2 shows a microprocessor-based circuit for controlling the yarn-feeding apparatus as shown in FIG. 1.

FIG. 2 shows a circuit diagram of the error detection unit in accordance with the present invention. The light emitting diodes 23–26 are connected in series to a resistor which in turn is connected to a source of positive voltage. The collectors of the photo-transistors 27–30 are connected to input terminals 40–43 of a microprocessor 31. In the preferred embodiment, this microprocessor 31 is an INTEL-type 8748. A first output terminal of this microprocessor 31 is connected through a switching transistor to a fault indication lamp 32 which is switched on by the microprocessor 31 if it turns off the knitting machine in response to the detection of a yarn breakage and/or a yarn over-feed and/or a yarn change fault. A second output terminal of the microprocessor 31 is connected through another switching transistor to a stop relay 37 interrupting the power supply of the knitting machine and thereby turning off its operation. A first pulse generator 38 which generates one pulse per revolution of the knitting machine is connected to an input terminal of the microprocessor 31. Similarly, a second pulse generator 39 generating a pulse train, the pulse train having a frequency which is proportional to the rotory velocity of the knitting machine, is connected to a further input terminal of the microprocessor 31. This pulse generator comprises a toothed disc secured to the rotating shaft of the knitting machine, so that this generator 39 outputs one pulse per tooth passing a sensor of the generator. The pulse train generated by the sensor 39 is the reference basis for the operation of the circuitry enabling the microprocessor to carry out its operation in synchronism with the operation of the knitting machine. By changing the number of teeth in this second pulse generator, it is possible to modify the time-dependency of the operations of the microprocessor with respect to the operation of the knitting machine. It will become more clear from the subsequent description that any time delays of the error detection unit defined by a predetermined number of pulses is generated by the second pulse generator can be modified by changing the number of teeth of the toothed disc. By varying the number of teeth the time basis can be amended, so that an error detection unit comprising a microprocessor having a certain program can be used for different types of knitting machines requiring different periods of time for the respective control operations.

Hereinafter, flow diagrams of the programs stored in a read-only memory of the microprocessor will be described with reference to FIGS. 3–8.

Figures 3, 4:
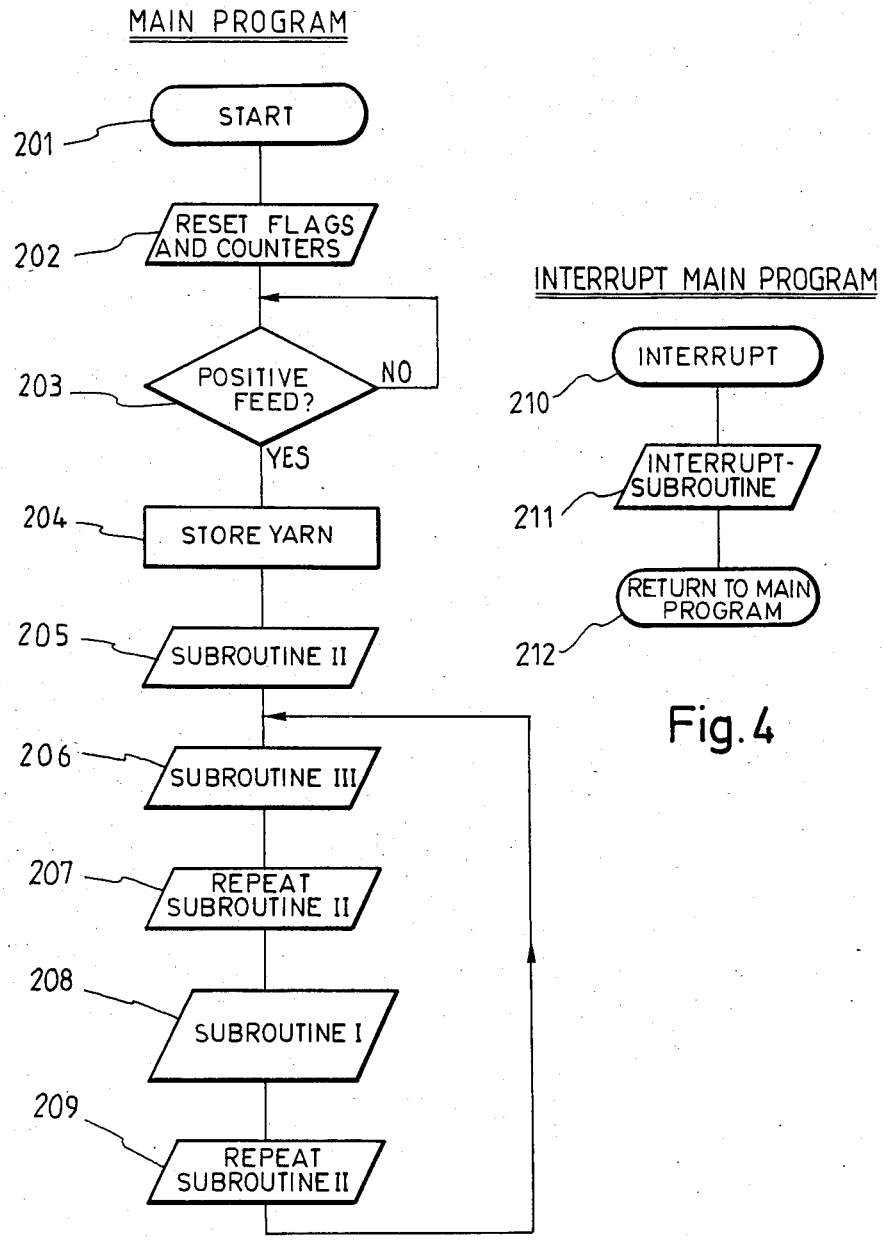
FIG. 3 shows a flow diagram of a main program.
FIG. 4 shows a flow diagram of an interrupt main program.

FIG. 3 shows a flow diagram of the main program for controlling the operation of the microprocessor 31. When switching on the main power switch of the knitting machine the execution of the main program is started at block 201. At block 202, the microprocessor 31 resets all flags and counters. Block 203 of the main program is a waiting routine during which the microprocessor checks whether the sensor signals generated by the transistors 27–30 represent the positive feeding of a yarn. If this condition is fulfilled, the microprocessor 31 stores data indicating which of the yarns FA, FB, FC or FD is fed to the knitting machine. At block 205 the program jumps to the sub-routine II, which will be described later with reference to FIG. 6. Having carried out sub-routine II, the program jumps to sub-routine III at block 206. This sub-routine III will be described in detail with reference to FIG. 7. At blocks 207–209, the microprocessor repeats the sub-routine II, carries out the sub-routine I and repeats again the sub-routine II. Hereinafter, the program returns to block number 206. Hence, the execution of the sub-routines of blocks 206–209 is periodically repeated during the operation of the knitting machine.

FIG. 4 shows a flow diagram of the interrupt main program. Each time the knitting machine has run through a predetermined working angle, the second pulse generator 39 generates one pulse. For example, the second pulse generator generates one pulse per degree of rotary movement of the knitting machine. The second pulse generator 39 is connected to an interrupt-input of the microprocessor. Each time a pulse is fed to this interrupt-input, the execution of the main program is interrupted so that the microprocessor is enabled to process this information in an interrupt program. In other words, when receiving a pulse at the interrupt input terminal, the actual content of the working register or accumulator is stored in a predetermined memory cell, wherein the microprocessor simultaneously stores the number of the program step to be executed next after carrying out the interrupt routine. Hence, the microprocessor is enabled to interrupt the main program at any program step and to return to the next program step after carrying out the interrupt main program without losing any data.

After receipt of a pulse generated by the second pulse generator 39, the microcomputer jumps to block 210 which is the start of the interrupt main program. At block 211 the microprocessor goes to an interrupt-sub-routine which will be described in detail with reference to FIG. 8. In this sub-routine the respective content of the counters is refreshed. Hereinafter, the microprocessor goes to the next step of the main program.

Figure 5:
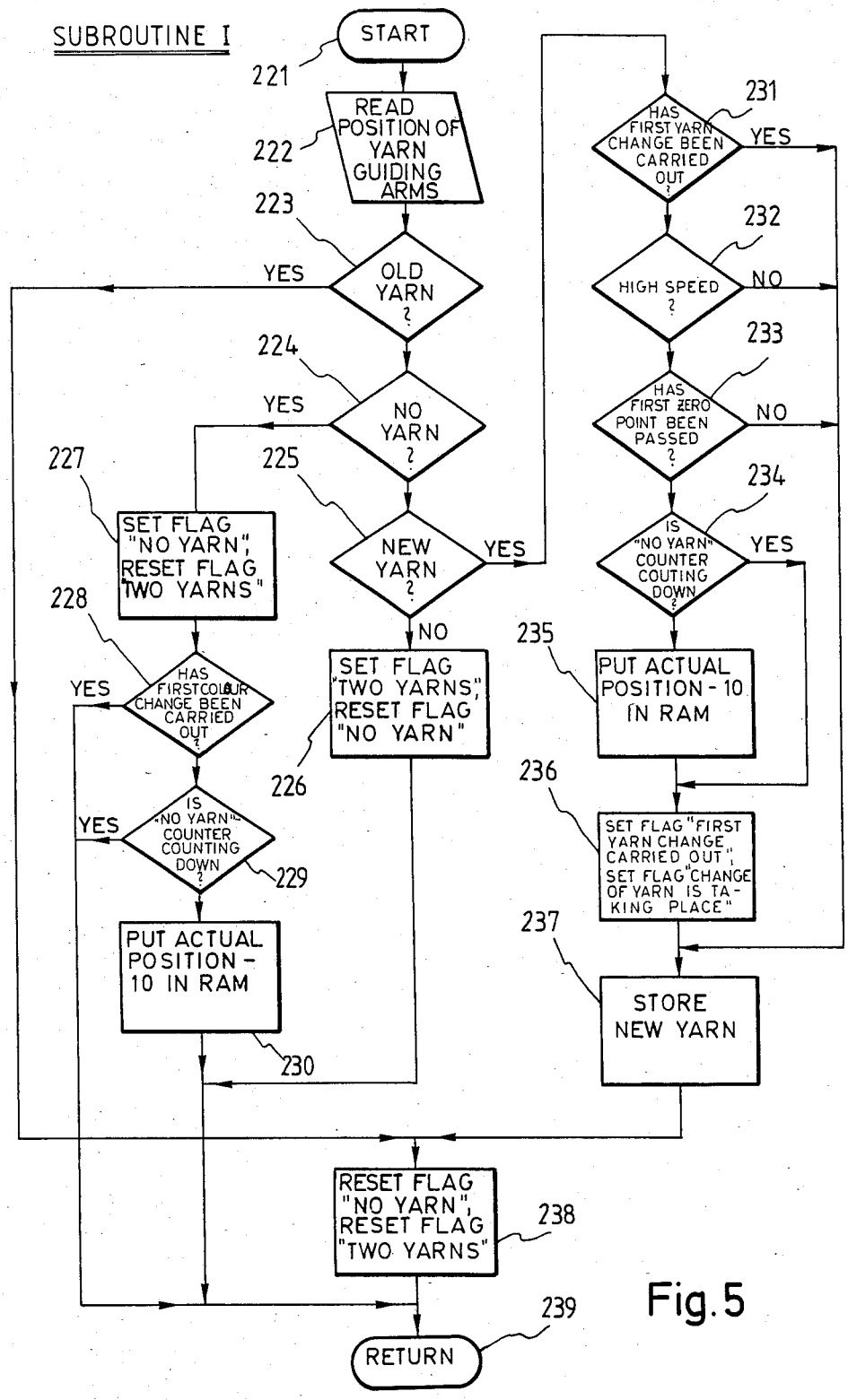
FIG. 5 shows a flow diagram of a first sub-routine.

FIG. 5 is a flow diagram of the sub-routine I which is carried out at block 208 of the main program. Block 221 is the start of this sub-routine. At block 222 the microprocessor reads the signals applied to its input terminals 40–43 representing the feeding-condition or non-feeding-condition of each yarn FA–FD.

At block 23, the microcomputer compares the number of the yarn which is fed to the knitting machine with a stored number of the yarn which was fed to the knitting machine at a previous execution of sub-routine I. If sub-routine I is carried out for the first time, there already exists an information regarding the yarn fed to the knitting machine prior to the execution of sub-routine I, as the actual yarn fed to the knitting machine has been determined at blocks 203 and 204. If the yarn fed to the knitting machine has not been changed since the last execution of this sub-routine, the condition "old yarn" is fulfilled, so that the program execution jumps to block 238. If not, the microcomputer checks at block 224 whether no yarn is fed to the knitting machine. This condition can only be fulfilled in case of a yaarn breakage or during the changing of yarns, if the knitting machine is of the "non-overlapping"-type, i.e. if no yarn is fed during the changing of yarns. If the condition "no yarn" is fulfilled, the microprocessor jumps to block 27. At block 27 it sets the flag "no yarn" and resets the flag "two yarns". These flags are read during the execution of the interrupt-sub-routine. Hereinafter, the microprocessor determines whether a first change of yarns corresponding to a first colour change has already been carried out. This is accomplished by reading a flag "first colour change carried out". If this flag is set, the angular position of the knitting machine of the moment of changing of yarns has already been determined. If not, this determination must be carried out at blocks 229 and 230. At block 229, the microcomputer checks whether the counter for "no yarn" is counting down. If so, it jumps to the return step 239 of the sub-routine I. If this condition is not fulfilled, it stores the actual position corresponding to the count of a counter for "actual position" minus a safety marginal of 10 at a predetermined location of its random excess memory. Thereinafter, this loop is terminated by executing the return-step of block 239.

In case the condition of block 224 is not fulfilled, that means if the question "no yarn?" is denied, the microprocessor checks at block 225 whether the signal combination received at its input terminals 40–43 represents that only a new yarn is fed to the knitting machine. If this condition is not fulfilled, at least two yarns are fed simultaneously to the knitting machine. This erroneous condition is the so-called two-yarn condition. In this case, the microcomputer sets the flag "two yarns" and resets the flag "no yarn". By doing so, the corresponding counter for "two yarns" is started, which will be described with reference to FIG. 8. Thereinafter, the microprocessor terminates this loop by jumping to the return step 239.

If the question in accordance with block 225 is answered in the affirmative, the execution is continued at block 231, at which the microprocessor checks whether the first yarn change has already been carried out by examining the condition of a corresponding flag. If so, the program is continued at block 237. If not, the execution is continued at block 232. At block 232 the microcomputer checks the condition of a flag having the content 1 in case the machine is working in its normal high speed mode. If this flag is not set, i.e. during the so-called "crawl speed mode" of the knitting machine, the determination of the yarn changing position cannot be carried out, so that the execution is continued at block 237.

Thereinafter, the microprocessor checks whether the first pulse generator has already generated a pulse indicating that a zero point has been passed. In this case, a corresponding flag is set. If this flag is in its reset condition, the microprocessor jumps to block 237. Otherwise it checks at block 234 whether the counter for "no yarn" is counting down. If not, the microprocessor reads the actual working position from a position counter, subtracts a number of ten from this count and stores the resulting data at a predetermined position of the random access memory (RAM). In other words, this loop serves for determining the yarn changing position data during the first cycle of the knitting machine which is carried out in its normal high speed mode. At block 236 the flag "first yarn change carried out" and the flag "change of yarn is taking place" are set. Thereinafter, the microprocessor stores at block 237 the number of the new yarn fed to the knitting machine, as this information will be required during the next execution of sub-routine I at blocks 223–225. At block 238, the flags "no yarn" and "two yarns" are reset. The sub-routine is completed by going to block 239 at which the microcomputer jumps back to the main program.

Figure 6:
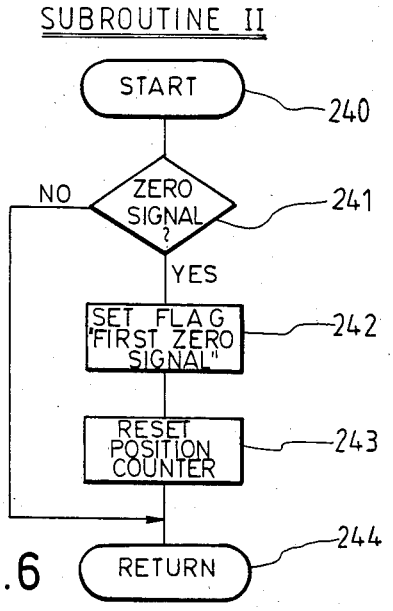
FIG. 6 shows a flow diagram of a second sub-routine.

Sub-routine II as shown in FIG. 6 is a program for reading the "zero-signal", i.e. a program for reading the pulses generated by the first pulse generator 38 which outputs one pulse per revolution of the knitting machine. This subroutine starts at block 240. At block 241, the microprocessor checks whether the first generator 238 has generated one pulse. If this question is answered in the negative, the microprocessor goes to block 244. If this question is answered in the affirmative, it sets the flag "first zero signal" and resets the position counter, as this angular position of the knitting machine corresponds to zero degree. At block 244, the microprocessor returns to the main program.

Figure 7:
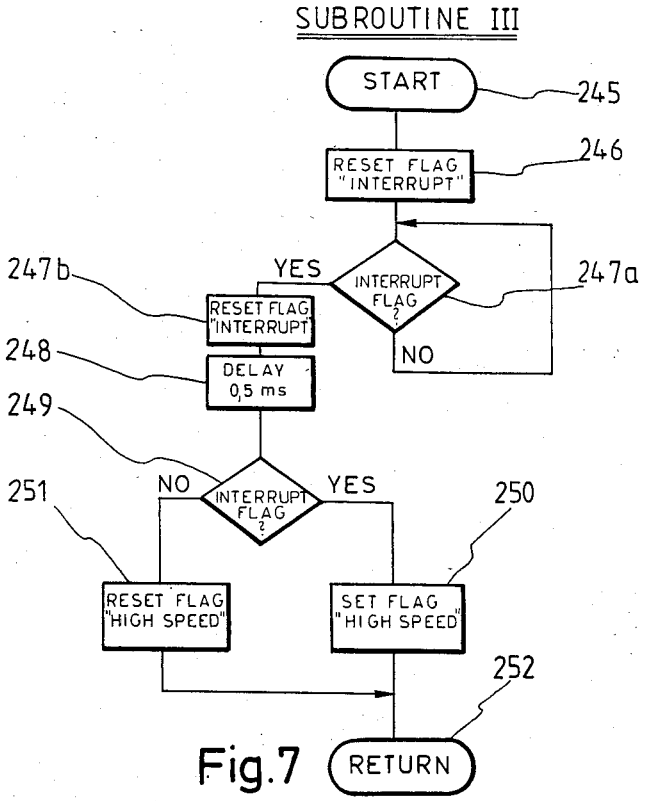
FIG. 7 shows a flow diagram of a third sub-routine.

FIG. 7 is a flow diagram of the sub-routine III, for determining the rotary velocity of the knitting machine. This sub-routine is entered at block 245. At block 246 the microprocessor resets the "interrupt" flag. The interrupt flag is automatically set each time the microprocessor receives one pulse from the second pulse generator 39. Block **247*a* having a no-branch which terminates at its input is nothing else than a waiting routine. After receipt of one pulse from the second pulse generator, the question of block 247*a* is answered in the affirmative, so that the execution is further prosecuted at block 247*b*, by resetting the interrupt flag. Block 248 is a time-delay instruction which can be implemented by a counting routine requiring a corresponding time for being executed. This time-delay is 0.5 milliseconds. The time-delay is a little bit longer than the period of time between two subsequent pulses generated by the second pulse generator at the normal high speed mode of the knitting machine. Hence, the interrupt flag is again set by the next pulse generated by the second pulse generator if the knitting machine is working at its normal high speed mode. Hence, the velocity of the knitting machine can be checked by examining the state of the interrupt flag after lapse of the time-delay. If the interrupt flag is again set, the microprocessor sets the flag "high speed" at block 250, wherein it resets this flag in case that the interrupt flag is not set after lapse of the tine-delay. Thereinafter, it returns to the main program at block 252**.

Figure 8:
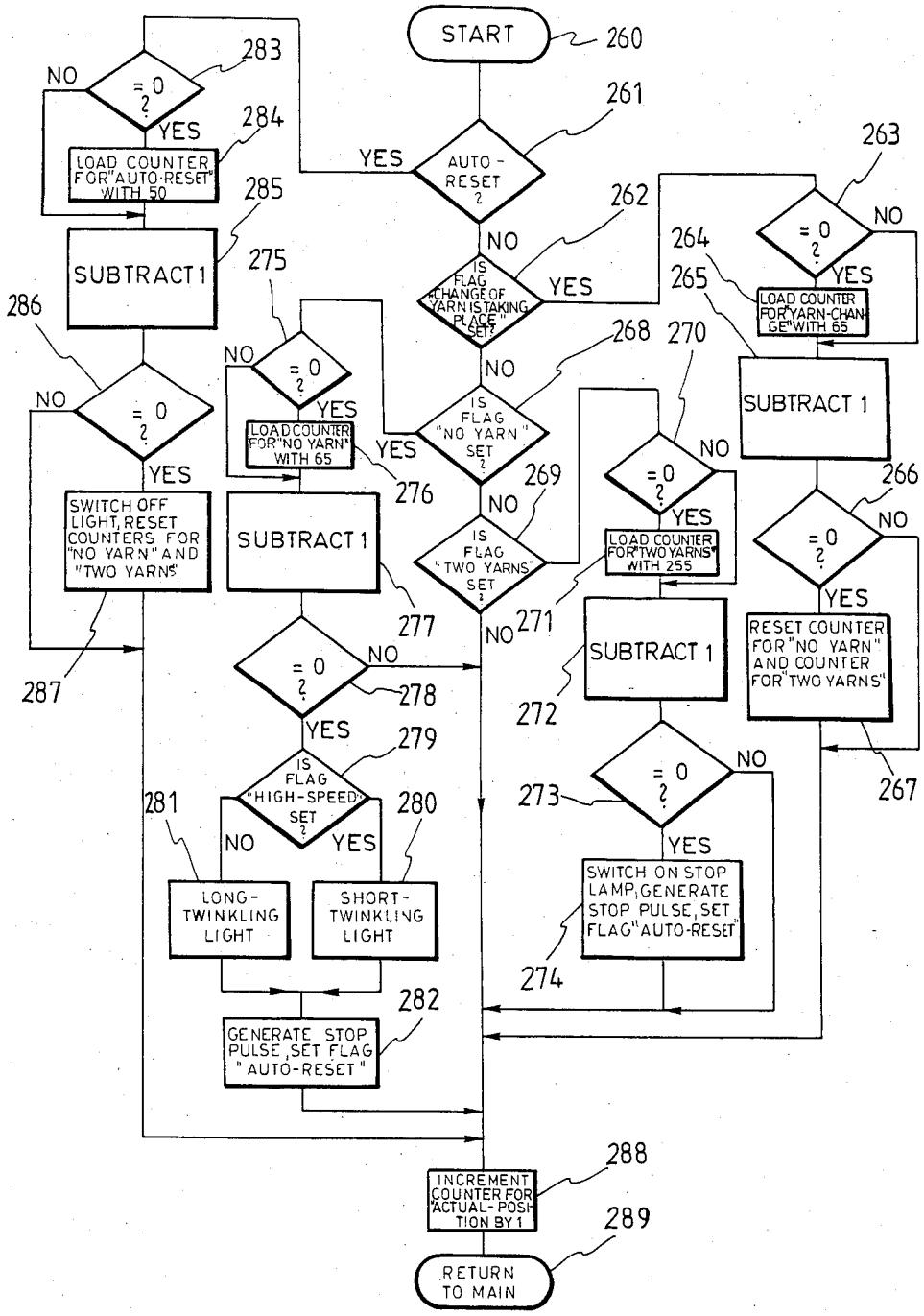
FIG. 8 shows a flow diagram of an interrupt-sub-routine.

FIG. 8 shows the flow diagram of the interrupt-subroutine, which is carried out at block 211 of the interrupt main program shown at FIG. 4. This routine is entered in by the microprocessor at block 260. At block 261 the microprocessor checks whether a flag for "auto-reset" is set. This flag belongs to a counter for automatically resetting the counters for "no yarn" and "two yarns", a predetermined number of pulses of the second pulse generator after turning off of the knitting machine. At block 262 the microprocessor checks whether the flag for "change of yarn is taking place" is set. If this condition is fulfilled, the microprocessor examines at block 263 whether the content of the counter for "yarn-change" is zero. In this case, the pulse generated by the second pulse generator which caused the microprocessor to enter into the present interrupt-sub-routine is the first pulse since the occurrence of a sensor signal combination representing that the changing of yarn is taking place. At block 264 the microprocessor loads the counter with 65, as the yarn-changing operation takes a period of time which is shorter than the time required by the second pulse generator for generating 65 pulses. At block 265, the microprocessor decrements this counter by 1. At block 266 it compares the content with zero, jumps to block 288 if this condition is not fulfilled and goes to block 267 if this condition is fulfilled. In the latter case, it resets the counters for "no yarn" and "two yarns", so as to disenable the turning off of the knitting machine by these counters. In other words, the knitting machine cannot be stopped as long as the content of these counters does not exceed a predetermined boundary.

If the question of block 262 is answered in the negative, i.e. if the flag "change of yarn is taking place" is not set, the microprocessor continues to execute the program at block 268. At block 268 it checks whether the flag "no yarn" is set. If not, it checks at block 269 whether the flag "two yarns" is set. If not, it jumps to block 288, in which the counter for "actual position" is incremented by 1. The count of this counter is directly proportional to the working position of the knitting machine. At block 289 the microprocessor returns to the main program. If the question of block 269 is answered in the affirmative, i.e. if the flag "two yarns" is set, the microprocessor enters a two-yarn-error-routine at block 270. At this block it checks whether the content of the counter for "two yarns" is zero. This condition is fulfilled if the microprocessor enters this branch of the program for the first time since the occurrence of the sensor signal combination representing the simultaneous feeding of at least two yarns. In this case, the corresponding counter for "two yarns" has to be supplied with a start value of 255, as the simultaneous occurrence of two sensor signals only represents a two yarn condition if this signal combination continues during the generation of more than 255 pulses generated by the second pulse generator. At block 272 the microprocessor decrements the counter. At block 273 the content of the counter for "two-yarns" is compared with zero. If the count equals zero, two yarn feeding takes place, so that the microprocessor switches on the stop lamp 32 (FIG. 1), generates a stop pulse which is fed to the stop relay 37 and sets the flag for "auto-reset". If the condition of block 273 is not fulfilled, the microprocessor jumps to block 288.

If the question of block 268 is answered in the affirmative, the program execution jumps to block 275. At block 275 the microcomputer compares the content of the counter for "no yarn" with zero, loads this counter with 65 if this condition is fulfilled, jumps to block 277 if this condition is not fulfilled and decrements the counter by 1 at block 277. If the content of the counter is different from zero it jumps to block 288. Otherwise, it checks the condition of the flag for "high-speed". In case of a no yarn condition during the high speed operation of the knitting machine, the microprocessor turns on a short-twinkling light, wherein it turns on a long-twinkling light in case of a crawl speed mode of the knitting machine. Thereinafter, it generates a stop pulse fed to the stop relay 37 and sets the flag for "auto-reset" at block 282. Then it jumps to block 88 where the microprocessor increments the counter for the actual position of the knitting machine.

In case the flag for "auto-reset" is set when the microprocessor carries out the examination in accordance with block 261, it jumps to block 283. Blocks 283–287 represent a counting routine similar to the counting routine of the counter for "two yarns" as described with reference to blocks 270–274. However, in this case the counter for "auto-reset" is loaded with a start value of 50. At block 287, i.e. after counting down the counter for "auto-reset" the stop lamp 32 is switched off and the counters for "no yarn" and "two yarns" are reset. Hence, the counter for "auto-reset" automatically prepares a circuit for the next machine cycle after turning off the knitting machine.

Figure 9:
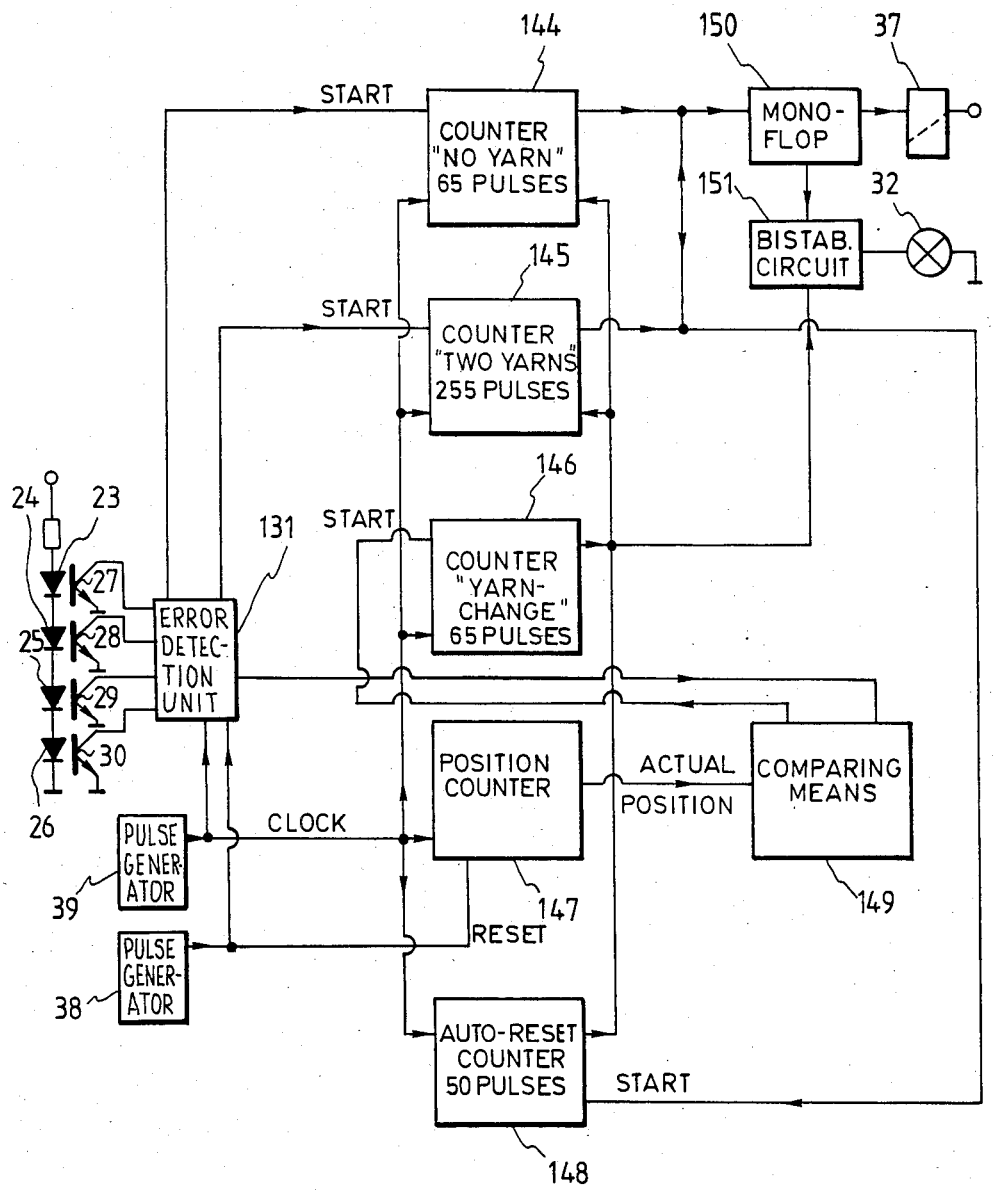
FIG. 9 shows a circuit diagram of a second circuit for controlling the operation of the yarn-feeding apparatus as shown in FIG. 1.

FIG. 9 shows a circuit diagram of the error detection unit in accordance with the present invention, wherein the respective counters are implemented by hardware-circuits and not by software-routines as used in the embodiment described with reference to FIGS. 2–8. This embodiment includes opto-electronic sensors 23–30, as shown in and described with reference to FIG. 2. These sensors are connected to an error detection unit 131 comprising gates for deriving respective error signals from the sensor signals. In other words, this error detection unit 131 generates a first output signal if the sensor signal indicates that no yarn is fed to the knitting machine, generates a second output signal if the sensor signals indicate that at least two yarns are fed simultaneously to the knitting machine. The first mentioned error signal is fed to a first counter 144, whereas the last mentioned error signal is fed to a second counter 145. In addition, there are provided counters 146, 147 for "yarn change" and for the actual position of the knitting machine. A first pulse generator 38 generating one pulse per revolution of the machine is connected to the error detection unit and to the position counter 147. A second pulse generator 39 generating one pulse per working angle unit of the knitting machine is connected to input terminals of these four counters 144–147 and to the input terminal of an auto-reset counter 148.

The error detection unit counts the pulses received from the second pulse generator since the generation of a pulse by the first pulse generator until it detects the changing of yarns. At this moment it stores the count of the pulses received from the second pulse generator, diminished by a predetermined safety margin. The comparing means continuously compares the count of the position counter 147 with the yarn changing position data stored in the error detection unit 131 and starts the counter for "yarn change" as soon as the actual position exceeds the yarn changing position. During the counting operation of the counter 146 for "yarn change" it generates an output signal for resetting the first and second counters 144–145. The first and the second counters 144, 145 count the pulses received from the second pulse generator as long as they receive a corresponding error signal from the error detection unit 131. If their count equals to a respective maximum count of 65 pulses in case of the first counter, or 255 pulses in case of the second counter, they generate an output signal for setting a monoflop 150 which in turn actuates a stop-motion relay 37. When starting again the knitting machine the counter 148 for "auto-reset" is actuated by the output signal of the first or second counter 144, 145 and resets these counters after receipt of 50 pulses from the second pulse generator 39.

It should be noted that the present invention has equal application to plain knitting machines, although a preferred embodiment of the present invention has been described with reference to a circular knitting machine.

It should also be noted that the opto-electronic position sensors 23–30 can be replaced by mechanical position sensors.

The working position sensor comprising two pulse generators and a counter can be replaced by any angle measuring instrument or displacement measuring instrument.

Appendix A shows a print out of the object code as stored in the read only memory of an embodiment in accordance with FIGS. 1–8.

APPENDIX A

| | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0000 | 04 | 09 | 00 | 04 | 09 | 00 | 00 | 04 | 9A | 15 | 9A | 00 | 89 | FF | 85 | A5 |
| 0010 | C5 | B8 | 3F | 27 | 02 | A0 | E8 | 15 | 23 | FF | 62 | 45 | 25 | 14 | 58 | 37 |
| 0020 | 53 | 30 | AE | C6 | 09 | D3 | 20 | C6 | 35 | FE | D3 | 30 | C6 | 35 | FE | D3 |
| 0030 | 10 | C6 | 37 | 04 | 09 | 24 | 00 | 44 | 00 | D5 | A5 | 16 | 3D | BF | 0A | BE |
| 0040 | 64 | 16 | 4D | EE | 41 | EF | 3F | C5 | FC | 53 | F7 | AC | 83 | 76 | 52 | B5 |
| 0050 | 04 | 3D | C5 | FC | 43 | 08 | AC | 83 | D5 | BC | 00 | 09 | AE | 09 | DE | C6 |
| 0060 | 67 | FC | C6 | 58 | CC | 04 | 5D | 1C | FC | 72 | 71 | BF | 0A | EF | 6D | 04 |
| 0070 | 5D | FE | 83 | C5 | 89 | 80 | 00 | 99 | 7F | 36 | 83 | BF | 0A | EF | 81 | 04 |
| 0080 | 87 | 26 | 7D | FC | 52 | 8C | 83 | FC | 43 | 04 | AC | 83 | 53 | FB | 43 | 20 |
| 0090 | AC | 02 | B8 | 20 | 27 | A0 | 18 | 18 | A0 | 83 | C5 | 2D | D5 | BA | OA | EA |
| 00A0 | A3 | 04 | D8 | 46 | 9F | 04 | D2 | C5 | FA | C6 | AF | CA | FA | C6 | E8 | FB |
| 00B0 | C6 | B6 | CB | FB | C6 | EB | FE | C6 | BD | CE | FE | C6 | EE | 95 | B6 | F1 |
| 00C0 | 95 | B8 | 20 | F0 | 18 | D0 | 96 | D2 | 18 | F0 | 18 | D0 | 96 | D2 | FC | 43 |
| 00D0 | 02 | AC | 23 | FF | 62 | C5 | 2D | 93 | 97 | B8 | 20 | 20 | 03 | 01 | 20 | F6 |
| 00E0 | E3 | 04 | A7 | 18 | 18 | 10 | 04 | A7 | 1A | 04 | AF | 1B | 04 | B6 | 1E | 04 |
| 00F0 | BD | 95 | 04 | D2 | 00 | 00 | 00 | 00 | 00 | 00 | 00 | 00 | 00 | 00 | 00 | 00 |
| 0100 | 14 | 58 | 53 | 0F | 96 | 0A | 14 | 73 | 24 | 00 | C5 | A9 | 14 | 73 | 14 | 39 |
| 0110 | 14 | 73 | 34 | 29 | 14 | 73 | 54 | 37 | 14 | 73 | 14 | 58 | 37 | 53 | 30 | C6 |
| 0120 | 27 | D3 | 10 | C6 | 27 | 24 | 0C | 04 | 09 | A5 | 14 | 58 | D5 | 37 | 53 | 30 |
| 0130 | D3 | 20 | C6 | 35 | B5 | FE | 53 | 0F | AE | C5 | D9 | C6 | 6E | D5 | FE | BC |
| 0140 | 04 | BF | 00 | 97 | 67 | E6 | 48 | 1F | EC | 43 | FF | 76 | 4F | B6 | B2 | 00 |
| 0150 | C6 | 77 | 07 | C6 | 57 | 24 | 82 | B6 | 6A | C5 | FC | 37 | 72 | 6A | B2 | 6A |
| 0160 | 34 | 8C | 85 | 95 | FC | 43 | 02 | 43 | 80 | AC | D5 | FE | C5 | A9 | FC | 53 |
| 0170 | EE | AC | BA | 00 | BE | 00 | 83 | C5 | FC | 43 | 01 | 53 | EF | AC | BE | 00 |
| 0180 | 24 | 8C | C5 | FC | 43 | 10 | 53 | FE | AC | BA | 00 | 83 | B6 | 9F | FA | 96 |
| 0190 | 9F | B8 | 20 | 97 | F0 | 03 | F6 | E6 | A0 | 18 | A0 | 18 | F0 | 18 | A0 | 83 |
| 01A0 | 18 | A0 | 18 | F0 | 07 | F2 | AA | 18 | A0 | 83 | 27 | 18 | A0 | C8 | C8 | 17 |
| 01B0 | A0 | 83 | C6 | 77 | 07 | C6 | BC | 07 | C6 | CA | 24 | 82 | C5 | FC | 32 | C2 |
| 01C0 | 24 | 77 | FB | 97 | 03 | FA | F6 | 6E | 24 | 6A | C5 | FC | 32 | D8 | D5 | FE |
| 01D0 | 53 | 0F | C5 | 59 | C6 | 77 | 24 | 6E | FB | 97 | 03 | FA | F6 | 6E | D5 | FE |
| 01E0 | 53 | 0F | C5 | B8 | 30 | D0 | C6 | 6E | A9 | D5 | FE | C5 | 53 | 0F | 59 | A9 |
| 01F0 | 24 | 6E | 00 | 00 | 00 | 00 | 00 | 00 | 00 | 00 | 00 | 00 | 00 | 00 | 00 | 00 |
| 0200 | 85 | 95 | A5 | 14 | 58 | 53 | 0F | D3 | 0F | C6 | 17 | B5 | 14 | 58 | 37 | 53 |
| 0210 | 30 | D3 | 10 | C6 | 17 | 04 | 09 | 76 | 00 | 14 | 39 | 14 | 58 | 53 | 0F | D3 |
| 0220 | 0F | 96 | 2D | C5 | FC | 53 | FE | AC | BA | 00 | A5 | 44 | 0C | C5 | FC | 43 |
| 0230 | 01 | AC | 54 | 37 | A5 | 44 | 0C | C5 | FC | 02 | D2 | B1 | 32 | 43 | 12 | 77 |
| 0240 | 92 | 91 | 83 | FB | 96 | 6B | D5 | FE | BC | 04 | BF | 00 | 97 | 67 | E6 | 51 |
| 0250 | 1F | EC | 4C | FF | C6 | 5E | 07 | C6 | 5E | 07 | C6 | 5E | 44 | 68 | FE | 53 |

APPENDIX A-continued

| | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0260 | 0F | C5 | B8 | 30 | A0 | BB | 42 | 83 | 27 | 44 | 61 | D3 | 01 | 96 | A1 | BB |
| 0270 | 00 | FC | 53 | FD | AC | 44 | 37 | FA | 96 | 88 | FC | 72 | 80 | BA | 42 | 83 |
| 0280 | B6 | 85 | BA | 42 | 83 | BA | 03 | 83 | D3 | 01 | 96 | A1 | FC | 72 | A2 | 44 |
| 0290 | A7 | FE | 96 | 97 | BE | FF | 83 | FC | 72 | 9B | 83 | FE | D3 | 01 | C6 | AC |
| 02A0 | 83 | 83 | D5 | BC | D2 | 64 | 00 | D5 | BC | 28 | 64 | 00 | D5 | BC | 01 | 64 |
| 02B0 | 00 | FB | 96 | B7 | BB | 32 | 83 | D3 | 01 | 96 | A1 | BB | 00 | FC | 53 | BF |
| 02C0 | AC | 76 | CB | 14 | 58 | 53 | 0F | C6 | CB | C5 | A9 | 83 | 00 | 00 | 00 | 00 |
| 02D0 | 00 | 00 | 00 | 00 | 00 | 00 | 00 | 00 | 00 | 00 | 00 | 00 | 00 | 00 | 00 | 00 |
| 02E0 | 00 | 00 | 00 | 00 | 00 | 00 | 00 | 00 | 00 | 00 | 00 | 00 | 00 | 00 | 00 | 00 |
| 02F0 | 00 | 00 | 00 | 00 | 00 | 00 | 00 | 00 | 00 | 00 | 00 | 00 | 00 | 00 | 00 | 00 |
| 0300 | C5 | FC | 43 | 40 | AC | D5 | 8A | FF | BB | 0A | BE | 64 | BD | C8 | ED | 0E |
| 0310 | 14 | 73 | D5 | EE | 0C | EB | 0A | 9A | F0 | FC | AB | BD | FA | ED | 1D | 14 |
| 0320 | 73 | D5 | EB | 1B | 8A | 0F | FC | 37 | AB | BD | FA | ED | 2B | 14 | 73 | D5 |
| 0330 | BE | FA | EE | 32 | 14 | 73 | D5 | EB | 29 | 9A | 00 | 54 | 37 | C5 | FC | D5 |
| 0340 | D2 | 19 | 83 | 00 | 00 | 00 | 00 | 00 | 00 | 00 | 00 | 00 | 00 | 00 | 00 | 00 |

The embodiments of the invention in which an exclusive property or privilege is claimed are defined as follows:

1. In a yarn feeding apparatus for the selective positive feeding of several yarns to a knitting machine, including sensor means for generating sensor signals,, the sensor signals representing the respective feeding condition or non-feeding condition of the yarns, and an error detection unit connected to the sensor means for turning off the knitting machine in response to predetermined sensor signal combinations representing a yarn breakage and/or a yarn over-feed and/or a yarn change fault, the improvement comprising wherein the error detection unit includes a working position sensing unit for generating actual position data representing the working position of the knitting machine, a logic circuit for deriving a yarn changing signal from the sensor signals, the yarn changing signal indicating the changing of yarns, and a memory means storing yarn changing position data which are dependent on the working position of the knitting machine when the yarn changing signal indicates the changing of yarns, wherein the error detection unit determines whether the actual position data fall within a data range when the yarn changing signal indicates the changing of yarns, the data range being defined by the stored position data, and wherein the error detection unit disables the turning off of the knitting machine in response to the predetermined sensor signal combination if the actual position data fall within the data range.

2. Yarn-feeding apparatus as claimed in claim 1, wherein the knitting machine is a circular knitting machine having a needle cylinder and at least one knitting system, and wherein the position data generated by the working position sensing unit represent the angular position of the needle cylinder with respect to the at least one knitting system.

3. Yarn-feeding apparatus as claimed in claim 1, wherein the knitting machine is a circular knitting machine, and wherein the working position sensing unit includes a first pulse generator generating one pulse per revolution of the knitting machine, a second pulse generator generating a pulse train, the pulse train having a frequency which is proportional to the rotary velocity of the knitting machine, and a first counter connected to the first and second generators and counting the pulses generated by the second generator, said first counter being reset by the pulses generated by the first generator.

4. Yarn-feeding apparatus as claimed in claim 3, wherein the error detection unit reads the count of the first counter when the yarn changing signal indicates the changing of yarns and wherein the error detection unit subtracts a predetermined number from the count and stores the resulting yarn changing position data in the memory means.

5. Yarn-feeding apparatus as claimed in claim 4, wherein the error detection unit determines and stores the yarn changing position data during an initial working cycle of the knitting machine and maintains this yarn changing position data unchanged during subsequent machine cycles.

6. Yarn-feeding apparatus as claimed in claim 3, wherein the error detection unit includes a comparing means comparing the count of the first counter with the yarn changing position data, and a second counter connected to the comparing means and to the second generator, wherein the comparing means causes the second counter to count the pulses received from the second generator when the count of the first counter exceeds the yarn changing position data, wherein the second counter disables the turning off of the knitting machine during its counting operation, and wherein the second counter terminates the counting of pulses when its count exceeds a predetermined boundary.

7. Yarn-feeding apparatus as claimed in claim 6, wherein the maximum count of the second counter defined by the predetermined boundary corresponds to the length of the data range.

8. Yarn-feeding apparatus as claimed in claim 6, wherein the error detection unit includes a third counter, wherein the third counter is connected to the second pulse generator, wherein the error detection unit causes the third counter to count the pulses received from the second pulse generator during the occurrence of a sensor signal combination representing that no yarn is fed to the knitting machine, and wherein the third counter generates a stop signal for turning-off the knitting machine when its count exceeds a predetermined value.

9. Yarn-feeding apparatus as claimed in claim 8, wherein the error detection unit includes a fourth counter, wherein the fourth quarter is connected to the second pulse generator, wherein the error detection unit causes the fourth counter to count the pulses received from the second pulse generator during the occurrence of a sensor signal combination representing that at least two yarns are simultaneously fed to the knitting machine, and wherein the fourth counter generates a stop signal for turning off the knitting machine when its count exceeds a predetermined value.

10. Yarn-feeding apparatus as claimed in claim 8, wherein the second counter generates a reset signal during its counting operation, and wherein this reset signal is fed to a reset input of the third and/or fourth counter for disabling the turning off of the knitting machine.

11. Yarn-feeding apparatus as claimed in claim 8, wherein the error detection unit includes a microprocessor and wherein the logic circuit, the first, second, third and fourth counters and the comparing means are implemented by respective software routines stored in a memory of the microprocessor.

12. In a method for controlling the operation of a yarn-feeding apparatus for the selective positive feeding of several yarns to a knitting machine, wherein the yarn-feeding apparatus includes sensor means for generating sensor signals representing the respective feeding condition or non-feeding condition of the yarns and an error detection unit for turning off the knitting machine in response to predetermined sensor signal combinations representing a yarn breakage and/or a yarn overfeed and/or a yarn change fault, the improvement comprising wherein the knitting machine includes a working position sensing unit for generating position data representing the working position of the machine, and wherein the method includes the steps of: deriving yarn changing information from the sensor signals, said information representing the changing of yarns, determining yarn changing position data by reading the position data when the yarn changing information represents the changing of yarns, storing data having a predetermined dependency on the yarn changing position data, determining actual position data when one of said predetermined sensor signal combinations occurs, and disabling the turning off of the knitting machine if the determined actual position data is between a lower threshold and an upper threshold.

13. Method as claimed in claim 12, wherein the knitting machine is a circular knitting machine, wherein the lower threshold corresponds to a first angular position of the knitting machine, the first angular position being angularly offset with respect to the position corresponding to the yarn changing position data in a direction opposite to the working direction of the knitting machine, and wherein the upper threshold corresponds to a second angular position of the knitting machine, the second angular position being angularly offset with respect to the position corresponding to the yarn changing position data in the working direction of the knitting machine.

14. Method as claimed in claim 13, wherein the angle between the position corresponding to the yarn changing position data and the position corresponding to the upper threshold is greater than the working angle passed through by the knitting machine from the beginning to the completing of the yarn changing operation.

15. Method as claimed in claim 13, wherein the working position sensing unit of the knitting machine includes a first pulse generator generating one pulse per revolution of the knitting machine, and a second pulse generator generating one pulse per angle unit, wherein the method step of determining the yarn changing position data includes the step of counting the pulses generated by the second pulse generator between the generating of one pulse by the first pulse generator and the occurrence of a yarn changing information, and wherein the method step of storing data includes the step of subtracting a number of pulses corresponding to the angular offset between the first angular position and the position corresponding to the yarn changing position from the count and storing the resulting data defining the lower threshold.

16. Method as claimed in claim 15, wherein the upper threshold is defined by the sum of the resulting data and a predetermined number, and wherein the turning off is disabled if the count of the pulses generated by the second pulse generator from the generation of a pulse of the first pulse generator is between the lower and upper thresholds.

* * * * *